US005146994A

United States Patent [19]

Pleasants et al.

[11] Patent Number: 5,146,994

[45] Date of Patent: Sep. 15, 1992

[54] PACKING ASSEMBLY FOR USE WITH REELED TUBING AND METHOD OF OPERATING AND REMOVING SAME

[75] Inventors: Charles W. Pleasants; Pat M. White, both of Carrollton, Tex.; Ronald J. Fischer, Bakersfield, Calif.; Robert D. Harrison, Jr., Houston; John R. Setterberg, Jr., Dallas, both of Tex.

[73] Assignees: Otis Engineering Corporation, Carrollton; Shell Western E&P, Inc., Houston, both of Tex.

[21] Appl. No.: 635,900

[22] Filed: Dec. 27, 1990

Related U.S. Application Data

[63] Continuation of Ser. No. 468,599, Jan. 23, 1990, Pat. No. 5,000,265.

[51] Int. Cl.[5] ..... F21B 23/02

[52] U.S. Cl. ..... 166/387; 166/122; 166/131

[58] Field of Search ..... 166/122, 123, 131, 134, 166/181, 182, 193, 387; 285/146, 147

[56] References Cited

U.S. PATENT DOCUMENTS

| | | | |
|---|---|---|---|
| 2,290,142 | 7/1942 | Burt | 166/122 |
| 3,181,614 | 5/1965 | Brown | 166/122 |
| 3,215,207 | 11/1965 | Sizer | 166/122 |
| 3,456,723 | 7/1969 | Current et al. | 166/131 |
| 3,459,261 | 8/1969 | Cochran | 166/131 |
| 4,345,649 | 8/1982 | Baugh et al. | 166/120 |
| 4,436,150 | 3/1984 | Barker | 166/131 |
| 4,665,992 | 5/1987 | Franc | 166/387 |

*Primary Examiner*—William P. Neuder
*Attorney, Agent, or Firm*—Warren B. Kice

[57] ABSTRACT

A packing assembly which is connectable to reeled tubing and which can be inserted in and pushed through a wellbore tube by the reeled tubing. The packing assembly is hydraulically set in a locking and sealing position in the wellbore by fluid introduced from the reeled tubing and, after use, is hydraulically released and removed from the wellbore. An actuating apparatus is provided for hydraulically actuating the packing assembly and can be converted in a manner to pull the packing assembly from the wellbore. Prior to the removal of the packing assembly from the wellbore, the wellbore fluid pressure is equalized across the packing assembly.

24 Claims, 7 Drawing Sheets

PACKING ASSEMBLY FOR USE WITH REELED TUBING AND METHOD OF OPERATING AND REMOVING SAME

This is a continuation of copending application Ser. No. 07/468,599 filed on Jan. 23, 1990, now U.S. Pat. No. 5,000,265.

BACKGROUND OF INVENTION

The present invention relates to a packing assembly and a method of operating and removing same from a downhole wellbore tube and, more particularly, to such an assembly and method which can be used with reeled tubing.

In the operation of subterranean oil or gas wells, it is often necessary to use a packing assembly, in the form of a bridge plug or packer, for locking in the wellbore tube and providing a seal so that other operations can be performed in the tube. The packing assembly is usually designed to be removed from the wellbore tube when the operations are complete and the seal is no longer necessary.

Prior art techniques involved in these type of operations have often utilized wirelines or threaded remedial tubing which ar inserted through the wellbore tubing for running in and setting the packing assembly and then removing same when the operation is completed.

Reeled tubing has recently been used in place of wirelines and threaded tubing in some general applications since the reeled tubing has several advantages. For example, it can be more rapidly inserted into the well and may be more easily passed through the production tubing and related downhole equipment. Also, it can be used to convey fluids into the wellbore tube for cleaning and other operations associated with the particular application. Also, reeled tubing can traverse highly deviated wells which could otherwise not be transversed with wirelines or threaded remedial tubing in a controlled matter.

Reeled tubing has been used with packing assemblies in certain applications. In these arrangements the packing assembly is "set" in the wellbore tube by inflating a seal member with fluid which produces a seal that is less than completely satisfactory. Also, when it is desired to remove the packing assembly from the wellbore tube a conventional wireline tool has been used which requires a separate connection to the packing assembly.

SUMMARY OF THE INVENTION

It is an object of the present invention to provide a packing assembly and method for operating same in a wellbore tube which utilizes reeled tubing.

It is a further object of the present invention to provide an assembly and method of the above type in which the packing assembly can be hydraulically set in a locking and sealing position in the wellbore tube and then can be hydraulically released and removed.

It is a further object of the present invention to provide an assembly and method of the above type in which the reeled tubing can be used to push the packing assembly into the wellbore tube.

It is a further object of the present invention to provide a packing assembly apparatus and method of the above type in which washing fluid can be introduced into the wellbore tube.

It is still a further object of the present invention to provide an assembly apparatus and method of the above type in which an actuating apparatus is provided which can function as a pushing tool and can be easily converted into a pulling tool.

It is a still further object of the present invention to provide an assembly apparatus and method of the above type in which the pressure of the wellbore fluid can be equalized across the packing assembly.

Toward the fulfillment of these and other objects, according to the present invention a packing assembly is provided which is connectable to the reeled tubing and can be inserted in and pushed through the wellbore tube by the reeled tubing. The packing assembly is adapted to receive fluid from the reeled tubing for washing the wellbore tube and for hydraulically setting and releasing the packing assembly in and from a locking and sealing position, respectively. The packing assembly includes actuating apparatus for setting the packing assembly and pulling it from the wellbore. Prior to the removal of the packing assembly from the wellbore, the wellbore fluid pressure can be equalized across the packing assembly.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings wherein.

DESCRIPTION OF THE PREFERRED EMBODIMENT

Figure 1A:
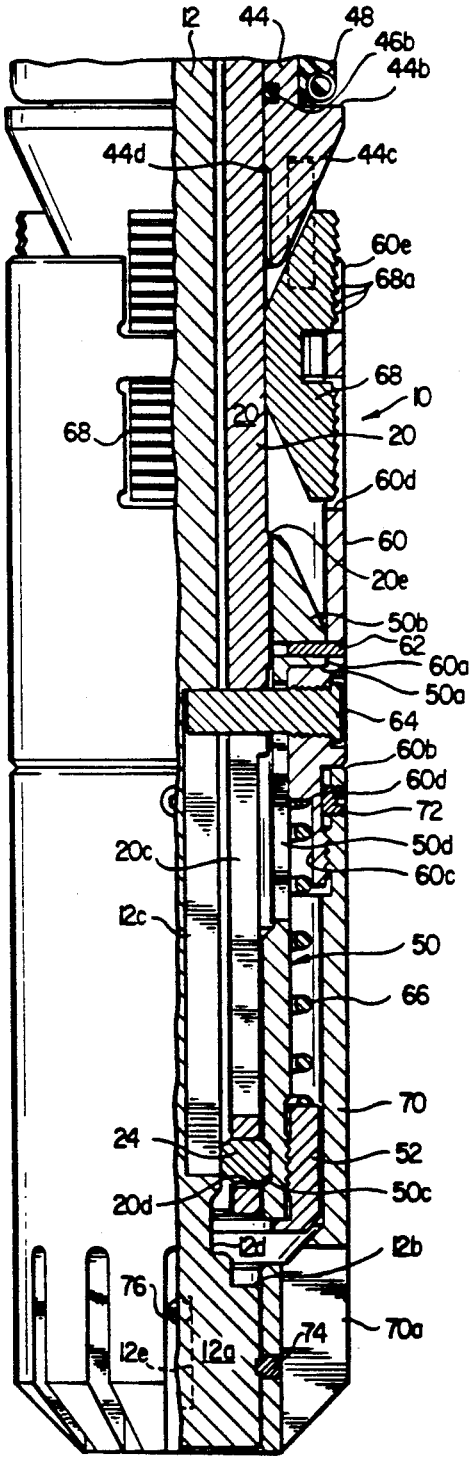
FIGS. 1A–1E are longitudinal sectional views of the packing assembly of the present invention set for insertion into a wellbore tube, with FIG. 1B being an upward continuation of FIG. 1A, FIG. 1C being an upward continuation of FIG. 1B, FIG. 1D being an upward continuation of FIG. 1C and FIG. 1E being an upward continuation of FIG. 1D.
Figure 1B:
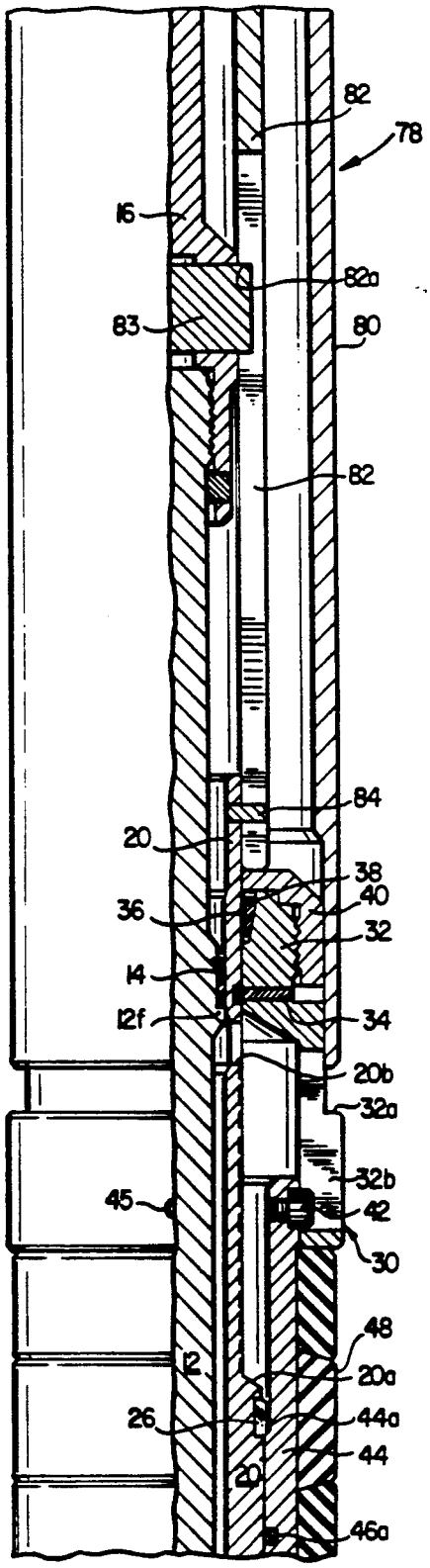

The packing assembly of the present invention will be shown and described, by way of example, in the form of a bridge plug referred to in general by the reference numeral 10 in FIGS. 1A–1D of the drawings which depict the bridge plug ready for insertion into a wellbore tube. Referring specifically to FIGS. 1A and 1B, the bridge plug 10 includes an inner mandrel 12 extending for the length of the assembly and having an enlarged lower end portion **12*a* to define a shoulder 12*b*. A longitudinal slot 12*c*, a recess 12*d* and six angularly spaced longitudinal slots 12*e* (one of which is shown) are formed in the lower portion of the inner mandrel 12 for reasons to be described. The outer surface of the inner mandrel 12 includes a raised portion 12*f* (FIG. 1B) which receives a seal ring 14. A top sub 16 is threadedly connected to the upper end portion of the inner mandrel 12** for connecting the latter mandrel to other components that will be described.

A tubular outer mandrel 20 extends around the inner mandrel 12 in a coaxial, slightly spaced relation, with the seal ring 14 in engagement with the corresponding inner surface of the outer mandrel. The upper end portion of the outer mandrel 20 has a reduced outer diameter which defines a shoulder **20*a* (FIG. 1B). Four angularly-spaced, radially-extending equalizing passages 20***b* (one of which is shown) are formed through the reduced diameter upper end portion of the outer mandrel which normally are axially spaced downwardly from the seal ring 14.

A longitudinal slot 20*c* (FIG. 1A) is formed through the outer mandrel 20 near its lower end, and four angularly-spaced, radial windows 20*d* (one of which is shown) extend through the outer mandrel between the slot 20*c* and its lower end. Four lugs 24 are respectively disposed in the windows 20*d* for reasons to be described. The slot 12*c* is shown in alignment with the lugs 24 in FIG. 1A for the convenience of presentation, it being understood that the slot is actually axially spaced from the lugs. The outer surface of an intermediate portion of the outer mandrel 20 is slightly stepped to form a shoulder 20*e* and a C ring 26 (FIG. 1B) is located in a circular groove formed in the outer surface of the outer mandrel 20 in a slightly spaced relation to the shoulder 20*a* for reasons to be described.

As shown in FIG. 1B, an upper wedge assembly 30 extends over the upper portion of the outer mandrel 20 in a coaxial relationship therewith and includes a retainer member 32 whose inner surface extends over a corresponding outer surface of the upper end portion of the mandrel 20. One or more angularly spaced shear pins 34 (one of which is shown) extend through corresponding openings in the retainer member 32 and into a recess formed in the outer surface of the outer mandrel 20. The pins 34 are adapted to shear in response to a predetermined shear force thereon to break the connection between the retainer member 32 and the outer mandrel 20 under conditions to be described. A tapered counterbore is formed in the upper end of the retainer member 32 and receives a plurality of slip segments 36 (one of which is shown) and a wave spring 38. The locking slip segments 36 and the wave spring 38 operate in a conventional manner to permit axial downward movement of the retaining member 32 relative to the outer mandrel 20, while locking against any upward movement thereof. An end cap 40 extends over the upper end of the retainer member 32 and is threadedly engaged therewith to retain the locking slip segments 36 and the wave spring 38 in the counterbore 32*a*.

The outer surface of the upper end portion of the retainer member 32 is stepped to define a shoulder 32*a* and a longitudinal slot 32*b* is formed in the retainer member which receives a radially extending bolt 42 projecting radially outward from the upper end of a tubular upper wedge member 44 (FIGS. 1A and 1B). The inner surface of the wedge member 44 is in close proximity to a corresponding outer surface of the outer mandrel 20, and the wedge member has a stepped inner surface to define a shoulder 44*a* which is engaged by the lower end of the C ring 26. The lower end portion of the wedge member 44 is enlarged to define a shoulder 44*b* (FIG. 1A) and is tapered radially inwardly as shown by the reference numeral 44*c* for reasons to be described. The inner surface of the enlarged lower end portion of the wedge under 44 is stepped to define a shoulder 44*d*. One or more angularly spaced shear pins 45 (one of which is shown in FIG. 1B) extend through corresponding openings in the retaining member 32 and the upper wedge member 44 to normally prevent relative movement therebetween.

A pair of seal rings 46*a* (FIG. 1B) and 46*b* (FIG. 1A) are defined in corresponding, slightly spaced annular recesses formed in the inner surface of the wedge member 44 and in engagement with the outer surface of the outer mandrel 20. A stack of sealing elements 48, of a resilient material, surrounds the outer surface of the wedge member 44 and is confined between the lower end of the retainer member 32 and the shoulder 44*b* of the upper wedge member 44.

As shown in FIG. 1A, a lower tubular wedge member 50 extends around the lower end portion of the outer mandrel 20 in a slightly spaced relation thereto. The upper end portion of the wedge member 50 is enlarged to define a downwardly facing shoulder 50*a* and is tapered upwardly and inwardly as shown by the reference numeral 50*b*. An annular groove 50*c* is formed in the lower portion of the bore of the wedge member 50 which receives the lugs 24 to normally retain the wedge member against axial movement relative to the outer mandrel 20. A longitudinal slot 50*d* is formed through the upper portion of the wedge member 50 in alignment with the slot 20*c* of the outer mandrel 20 and the slot 12*c* of the inner mandrel 12. An end cap 52 extends over, and is in threaded engagement with, the lower end portion of the wedge member 50.

A slip sleeve 60 extends over a portion of the wedge member 50 and the outer mandrel 20. The sleeve 60 has a stepped inner bore defining an internal shoulder 60*a* normally butting against the shoulder 50*a* of the wedge member 50. One or more angularly spaced pins 62 (one of which is shown) extend through corresponding openings in the slip sleeve 60 and in the wedge member 50 and are adapted to shear in response to a predetermined shear force thereon to break the connection between the sleeve 60 and the wedge member 50.

The outer surface of the lower end portion of the sleeve 60 is stepped to define a shoulder 60*b* and a counterbore 60*c* is provided in the lower end of the sleeve 60 to define an internal shoulder 60*d*. A radial opening is formed through the wall of the sleeve 60 which receives a retaining bolt 64. The bolt 64 extends through the aligned slots 50*d*, 20*c* and 12*c* of the wedge member 50, the outer mandrel 20 and the inner mandrel 12, respectively, to secure the latter members against relative angular rotation and to limit their axial movement. A helical compression spring 66 extends between the shoulder 60*d* and the upper end of the end cap 52.

Four angularly spaced slots 60*d* and 60*e* (two of each of which are shown in FIG. 1A) are formed in the slip sleeve 60 for respectively receiving four slip members, three of which are shown in FIG. 1A by the reference numeral 68. The inner surface of each slip member 68 rests against a corresponding portion of the outer surface of the outer mandrel 20, and the outer surface of each slip member is provided with a plurality of teeth 68*a*. The slip members 68 initially extend within the slip sleeve 60 with their teeth 68*a* extending outwardly but not beyond the outer surface of the sleeve. The slip members 68 are adapted to expand radially outwardly so that the teeth 68*a* engage the inner wall of a wellbore tube (not shown), as will be described.

An end cap sleeve 70 extends over the lower ends of the outer mandrel 20, the wedge member 50 and the slip sleeve 60. The upper end portion of the cap sleeve 70 extends over the lower end portion of the slip sleeve 60 with the upper end of the cap sleeve 70 abutting the shoulder 60*b*. One or more angularly spaced set screws 72 (one of which is shown) extend through angularly-spaced threaded openings in the cap sleeve 70 and engage the outer surface of the slip sleeve 60 to secure the cap sleeve in place. The diameter of the outer surface of the end cap 52 is slightly less than the diameter of the bore of the cap sleeve 70 so that the latter provides guiding support for sliding movement of the wedge member 50 as will be described.

The internal bore of the lower end portion of the cap sleeve 70 is tapered radially inwardly to a diameter slightly greater than the outer diameter of the enlarged lower end portion of the inner mandrel 12. One or more angularly-spaced pins 74 (one of which is shown) extend through angularly spaced openings formed in the lower end portion of the cap sleeve 70 and into corresponding flat bottom holes in the enlarged end portion 12*a* of the inner mandrel 12. One or more angularly-spaced pins 76 (one of which is shown) are slightly spaced upwardly from the pins 74 and extend through corresponding angularly spaced openings formed in the lower end portion of the cap sleeve 70 and into the corresponding aligned slots 12*e* in the outer surface of the enlarged lower end portion of the inner mandrel 12. A plurality of radial slots 70*a* are provided in the end portion of the cap sleeve 70 through which the pins 74 and 76 are inserted during installation.

The pins 74 are adapted to shear in response to a predetermined shear force thereon to break the connection between the cap sleeve 70 and the inner mandrel 12, under conditions to be described, to permit relative movement therebetween. During this movement the pins 76 ride in the slots 12*e* until they engage the lower ends of these slots to stop the relative movement between the cap sleeve 70 and the inner mandrel 12 until the fluid pressure builds up to a value sufficient to shear the pins, as also will be described.

Figure 1C:
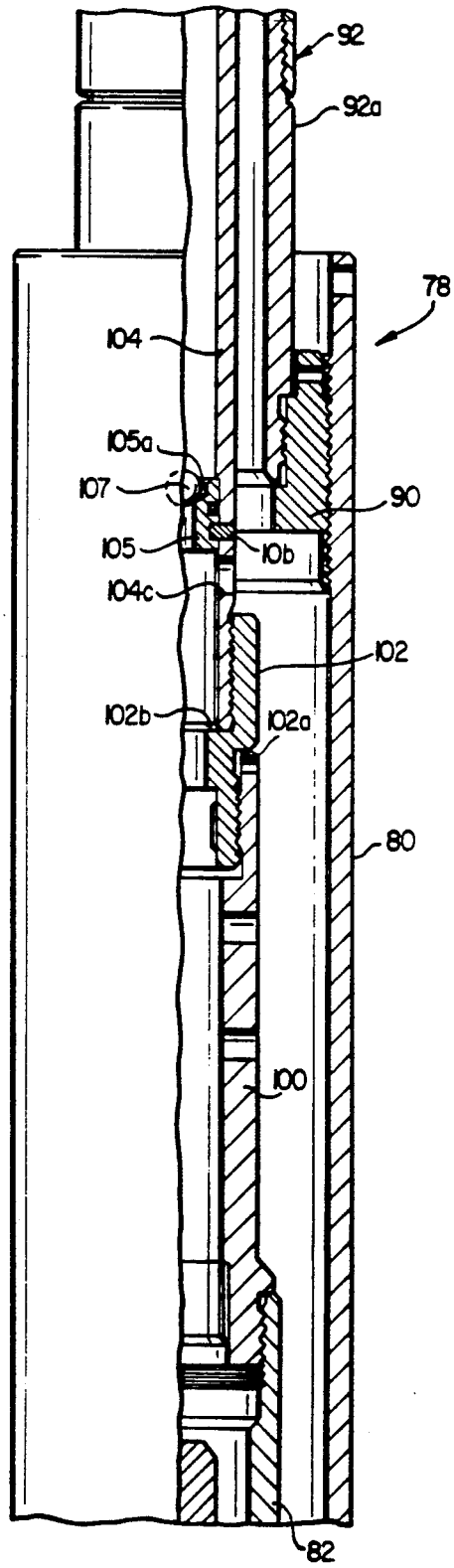
Figure 1D:
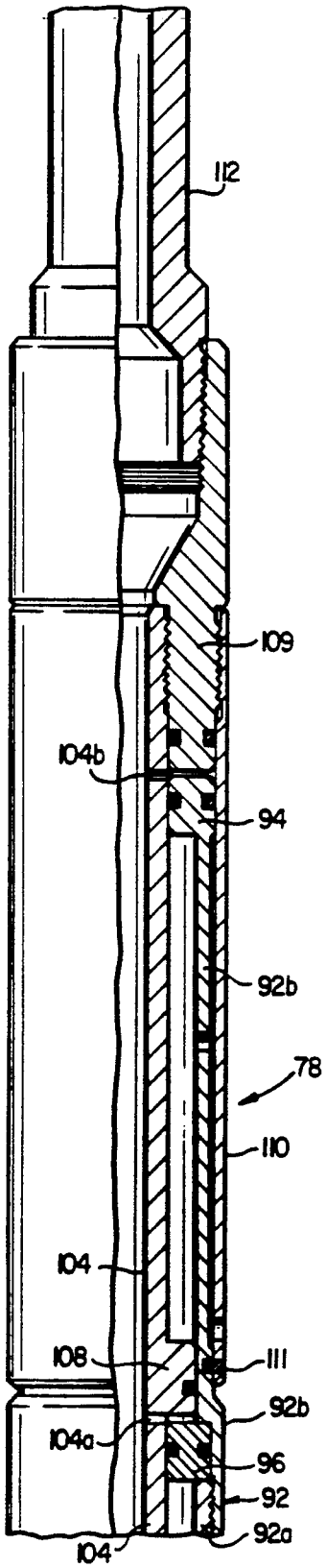

The packing assembly of the present invention includes an actuating apparatus 78, shown in general by the reference numeral 78, for connecting the bridge plug 10 to a section of reeled tubing, for inserting the bridge plug in a wellbore tube, for setting the bridge plug in a locking and sealing position and for removing the bridge plug from the wellbore tube. The actuating apparatus 78 is depicted in FIGS. 1B–1D and includes a drive sleeve 80 and a pulling sleeve 82 extending in a coaxial spaced relationship. The lower end of the drive sleeve 80 extends over the outer surface of the retainer member 32 including the end cap 40 (FIG. 1B), and the lower end portion of the pulling sleeve 82 extends over the upper end portion of the outer mandrel 20 and is connected thereto by six angularly spaced shear pins 84 (one of which is shown) extending through corresponding aligned openings in the sleeve 82 and the mandrel 20. The pins 84 are adapted to shear in response to a predetermined shear force thereon to release the pulling sleeve 82 from the mandrel 20 under conditions to be described.

As shown in FIG. 1C, the upper end portion of the drive sleeve 80 is threadedly connected to a ring adapter 90 which, in turn, is threadedly connected to the lower end portion of a two-piece drive cylinder 92 (FIG. 1C and 1D). The cylinder 92 includes a lower cylindrical portion 92*a* in threaded engagement with the ring adapter 90 and an upper cylindrical portion 92*b* threadedly connected to the lower cylindrical portion 92*a*. An annular drive piston 94 (FIG. 1D) is formed integrally with the upper cylindrical portion 92*b* and projects radially inwardly. An annular drive piston 96 also projects radially inwardly from an intermediate portion of the drive cylinder 92 and is secured in a recess defined between the upper end of the lower cylindrical portion 92*a* and an internal shoulder formed in the lower end portion of the upper cylindrical portion 92*b*.

The pulling sleeve 82 has a longitudinal, open-ended slot 82*a* formed therethrough which receives a rectangular pin 83 extending through an appropriate opening formed in the sub 16, to angularly align the sleeve 82.

As shown in FIG. 1C, the upper end portion of the pull sleeve 82 is connected, by an intermediate sleeve 100 and an adapter sleeve 102, to an upper sleeve 104. The connections between the pull sleeve 82, the intermediate sleeve 100, the adapter sleeve 102 and the upper sleeve 104 are all made by cooperating internal and external threads formed on corresponding end portions of the respective sleeves, in a conventional manner. The adapter sleeve 102 is stepped to define a downwardly facing shoulder 102*a* against which the upper end of the sleeve 100 abutts, and an upwardly facing internal shoulder 102*b* against which the lower end of the upper sleeve 104 abutts.

A ring seat 105 (FIG. 1C) is disposed in the bore of the upper sleeve 104 and is connected thereto by four angularly spaced shear pins 106 (only one of which is shown in FIG. 1C) which respectively extend through angularly spaced openings formed in the ring seat and the sleeve. The upper end of the ring seat 105 is formed with a seat surface 105*a* to define a seat for a ball valve 107 which is dropped onto the seat to seal the bore of the sleeve 104, under conditions to be described. The pins 106 are adapted to shear under a predetermined shear force to break the connection between the ring seat 105 and the sleeve 104 and release the ring seat for axial movement.

As shown in FIG. 1D, an annular piston 108 is formed on the outer surface of the sleeve 104. The outer diameter of the piston 108 is slightly less than the inner diameter of the cylindrical portion 92*b* and, in the position of FIG. 1D, the piston 108 is in a closely spaced relationship to the piston 96 of the drive cylinder 92.

One or more radially extending, fluid passages 104*a* are formed through the drive sleeve 104 with one such passage being shown in FIG. 1D. The passages 104*a* permit fluid to pass from the bore of the sleeve 104 into a chamber defined between the confronting surfaces of the pistons 96 and 108. A plurality of angularly spaced, radially extending openings 104*c* extend through the lower end portion of the sleeve 104 just below the ring seat 105 for reasons to be described.

Referring to FIG. 1D, the inner surface of a ring adapter 109 is in threaded engagement with the outer surface of the upper end portion of the upper sleeve 104. The lower end of the ring adapter 109 is in a slightly spaced relation to the upper end of the piston 94. One or more angularly-spaced, radially extending fluid passages 104*b*, one of which is shown, are formed through the upper end portion of the sleeve 104 between the ring adapter 109 and the piston 94 to permit fluid to pass into a chamber defined between the confronting faces of the ring adapter and the piston.

The upper end portion of an outer sleeve 110 (FIG. 1D) is in threaded engagement with the outer surface of the adapter 109. The inner surface of the sleeve 110 extends over the outer surface of the piston 94 and the cylindrical portion 92*b* in close proximity thereto. Four shear pins 111, one of which is shown, extend through corresponding, angularly spaced, aligned openings in the lower end portion of the sleeve 110 and cylindrical portion 92*b* to prevent relative axial movement therebetween in the absence of a predetermined shear force therebetween.

Figure 1E:
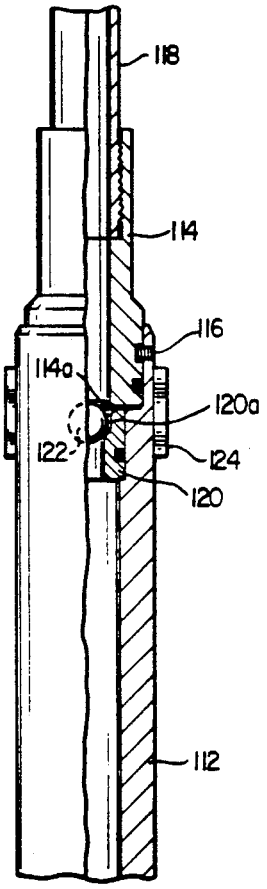

The lower end portion of an upper sleeve 112 is in threaded engagement with the upper end of the ring adapter 109 and, as shown in FIG. 1E, the sleeve 112 is connected to a sub 114 by four angularly spaced shear pins 116 (one of which is shown) extending through corresponding aligned openings formed in the sleeve 112 and the sub 114. The pins 116 are adapted to shear in response to a predetermined shearing force between the sub 114 and the sleeve 112 to release the sub from the sleeve under conditions that will be described. The sub 114 is formed with an enlarged lower end portion 114*a* which carries a seal ring 115 and with a reduced diameter upper end portion which is internally threaded for receiving a corresponding threaded lower end portion of a section of reeled tubing 118.

A ring seat 120, similar to seat 105 but having a bore larger than the diameter of ball 107, is provided in the upper end portion of the bore of the sleeve 112 and is formed with a seat surface 120*a* which is adapted to receive a ball valve 122, the diameter of which is greater than that of the ball valve 107, for sealing the bore of the sleeve 112 under conditions that will be described. Two lugs 124 are provided on the outer surface of sleeve 112 and are spaced 180° apart, for reasons to be described.

In operation, the bridge plug 10 is inserted into the wellbore tube in the position shown in FIGS. 1A–1E, i.e. with the actuating apparatus 78 connected between it and the reeled tubing 118. The bridge plug 1 is lowered and/or pushed to a desired position in the wellbore tube by the reeled tubing 118 and the actuating apparatus 78. During this movement through the wellbore tube any fluid in the latter tube enters the lower end of the bridge plug 10 through the slots 70, passes through the annular space between the inner mandrel 12 and the outer mandrel 20 and exits through the slots 20*b* in the outer mandrel and the slots 32*b* in the retaining member 32 to equalize the fluid pressure across the bridge plug.

When the bridge plug 10 reaches the desired position in the wellbore tube, the ball valve 107 is dropped through the reeled tubing 118 and passes through the actuating apparatus 78 until it rests on the seat surface 105*a* of the ring seat 105 (FIG. 1C). Also, a fluid is introduced, via the reeled tubing 118 to the sub 114 and thus passes into and through the sleeve 112, the ring adapter 109 and the upper sleeve 104 of the actuating apparatus 78. Since the ball valve 107 seals against any further downward flow of the fluid, the fluid volume and pressure build up in the sleeve 104 and the fluid flows into and through the passages 104*a* and 104*b* (FIG. 1D) formed through the sleeve 104. Thus fluid pressure builds up in the annular chamber defined between the pistons 96 and 108 and the annular chamber defined between the piston 94 and the lower end of the ring adapter 109. This fluid pressure drives the pistons 96 and 108 in opposite directions relative to each other (FIG. 1D) and drives the piston 94 and the ring adapter 109 in opposite directions (FIG. 1C). This shears the pins 111 (FIG. 1D) and, due to the lesser resistance to movement encountered by the drive sleeve 80, it moves downwardly while the pull sleeve 82 remains relatively stationary. Downward movement of the drive sleeve 80 continues until the lower end thereof engages the shoulder 32*a* of the retainer member 32 and forces it downwardly to shear the pins 34 (FIG. 1B) and release the retainer member from the outer mandrel 20. Further downward movement of the drive sleeve 80, and therefore the retainer member 32, forces the wedge member 44 against the locking slips 68 to urge the slips radially outwardly until their teeth 68*a* engage the inner wall of the wellbore tube and the bolt 42 nears the upper end of the slot 32*b* of the retainer member 32 as shown in FIG. 2B. During this movement, the slip segments 36 in the retainer member 32 prevent upward movement of the upper wedge assembly 30 relative to the outer mandrel 20.

By virtue of the teeth 68*a* of the locking slips 68 engaging the inner wall of the wellbore tube the bridge plug 10 is in its locking position and the drive sleeve 80 is locked against further downward movement. Additional shear forces thus build up on the shear pins 45 causing them to shear and permit downward movement of the retainer member 32 relative to the upper wedge member 44 and the slot 32*b* relative to the bolt 42. This axially compresses the sealing elements 48 and causes them to expand radially outwardly against the inner wall of the wellbore tube and thus seal against the passage of well fluid upwardly through the bridge plug. The force imparted between the drive sleeve 80 and the pulling sleeve 82 as described above is then transferred in the form of an upwardly directed force, to the pulling sleeve 82. Thus, an upwardly-directed, pulling force is applied to the outer mandrel 20 causing it to move upwardly relative to the inner mandrel 12 and both wedge members 44 and 50 to the position of FIGS. 2A–2D. Due to the engagement of the lugs 24 in the recess 50*c* (FIG. 2A) the lower wedge member 50 is also pulled upwardly with the outer mandrel 20 which compresses the spring 66.

Figure 2A:
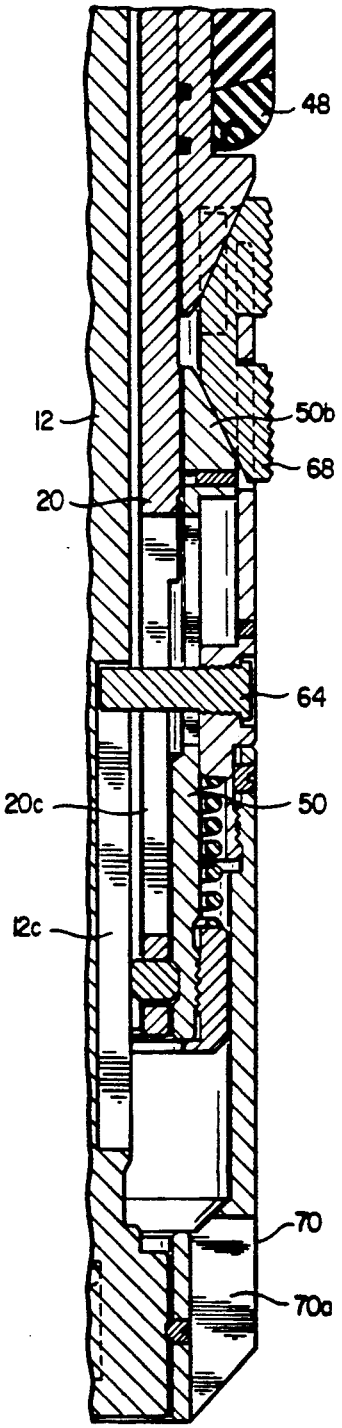
FIGS. 2A–2D, FIGS. 3A–3D and FIGS. 4A–4D are views similar to FIGS. 1A–1D, but depicting the packing assembly of the present invention in different operating modes.
Figure 2B:
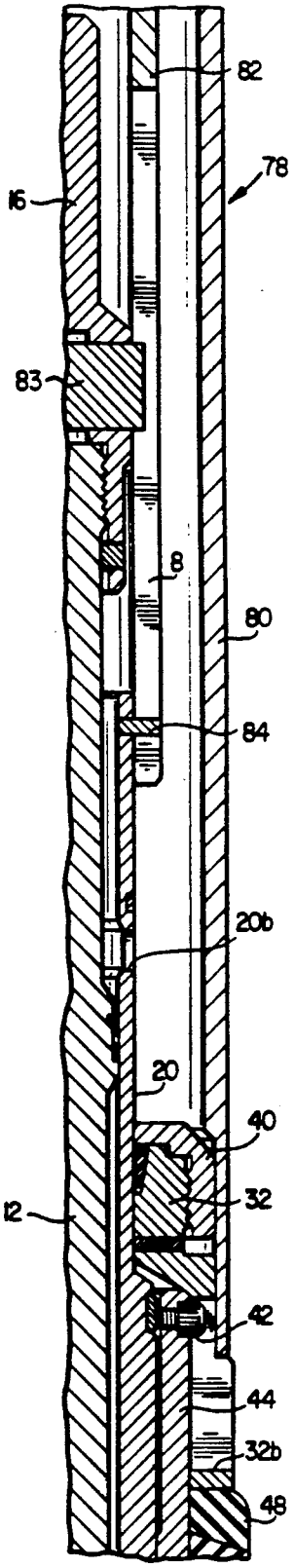

This upward movement of the outer mandrel 20 and the lower wedge member 50 continues until the latter wedge member engages the slip members 68 as shown in FIG. 2A to lock the slip members in their wellbore tube engaging position. The bridge plug 10 is thus locked in its "set" position with the seal elements 48 and the slip members 68 engaging the inner wall of the wellbore tube. It is noted that, in the set position of FIGS. 2A–2D, the equalizing passages 20*b* (FIG. 2B) extend above the seal ring 14. Thus, flow of well fluid from the wellbore through the bridge plug 10 as described above, is prevented.

Figure 2C:
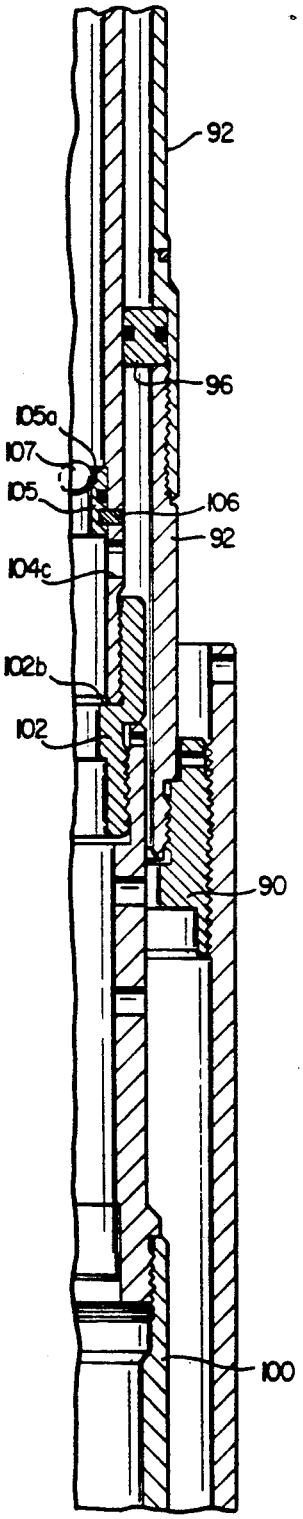
Figure 2D:
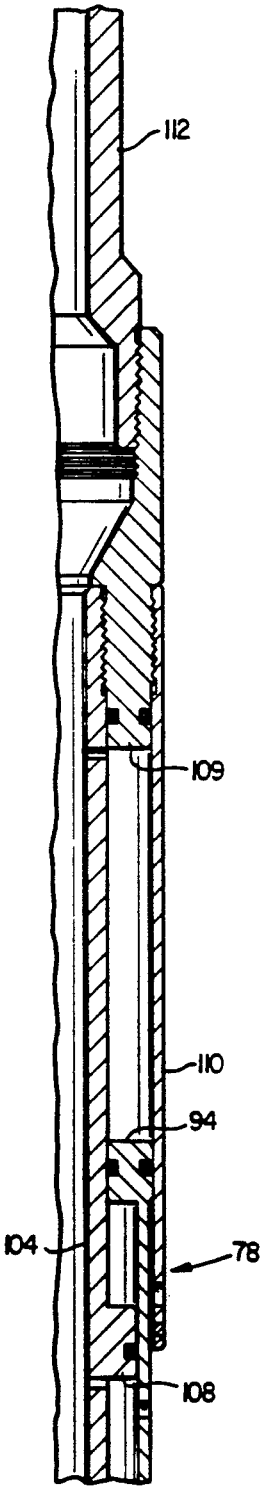

Further build up of fluid pressure in the actuating apparatus 78 in the above-described manner continues until a sufficient force is created to shear the pins 84 which disconnects the actuating apparatus 78 from the bridge plug assembly 10. Before the actuating apparatus 78 is removed from the wellbore tube, additional fluid is introduced into the actuating apparatus in the manner described above. The fluid pressure is allowed to build up in the sleeve 104 until a sufficient downwardly-directed force is exerted on the ball valve 107 and therefore the ring seat 105 to shear the pins 106 (FIG. 2C). The force of the fluid pressure then drives the ball valve 107 and the ring seat 105 downwardly until the lower end of the ring seat engages the shoulder 102*b* of the adapter ring 102. This exposes the openings 104*c* and permits fluid from the reeled tubing 118 to flow through the latter openings and relieve the fluid pressure. Then the reeled tubing 118 can be mechanically pulled upwardly, so that it, along with the actuating apparatus 78 can be pulled from the wellbore.

The ring seat 120 is for the purpose of disconnecting the reeled tubing from the actuating apparatus 78 in emergency situations such as for example, when the pins 106 prematurely shear before the pins 84 thus releasing the fluid pressure and rendering it impossible to hydraulically shear the latter pins. In these situations a ball valve 122 (FIG. 1E) is dropped through the reeled tubing 118 and into the sub 114 where it engages the seat surface 120*a* on the ring seat 120. Pressure thus builds up against the lower end of the sub 114, forcing it upwardly until the pins 116 shear, permitting removal of the reeled tubing 118 from the wellbore tube. Snubbing equipment, or the like, may then be used to lower into the wellbore tube a string of pipe on the lower end of which is carried a suitable fishing tool which will engage the lugs 124 to enable the actuating apparatus 78 and the bridge plug to be pulled from the wellbore tube.

Figure 3A:
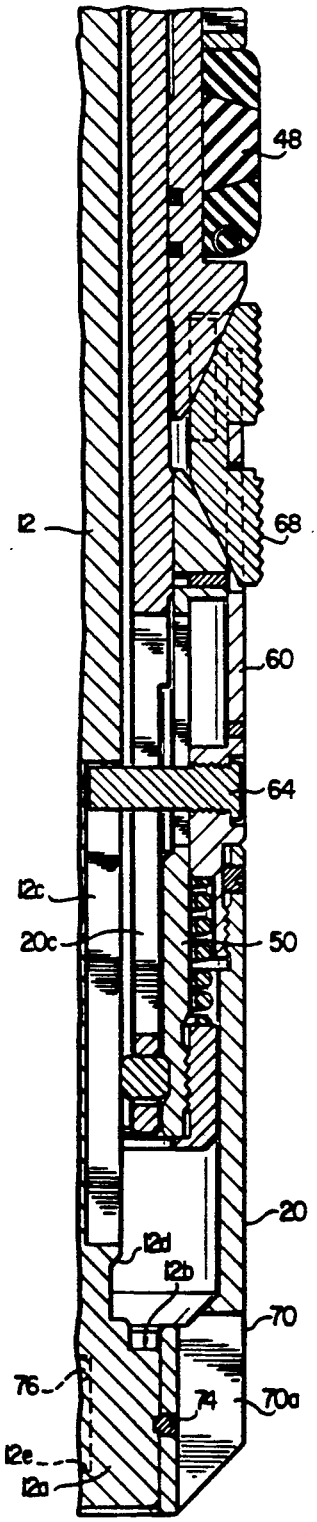
Figure 3B:
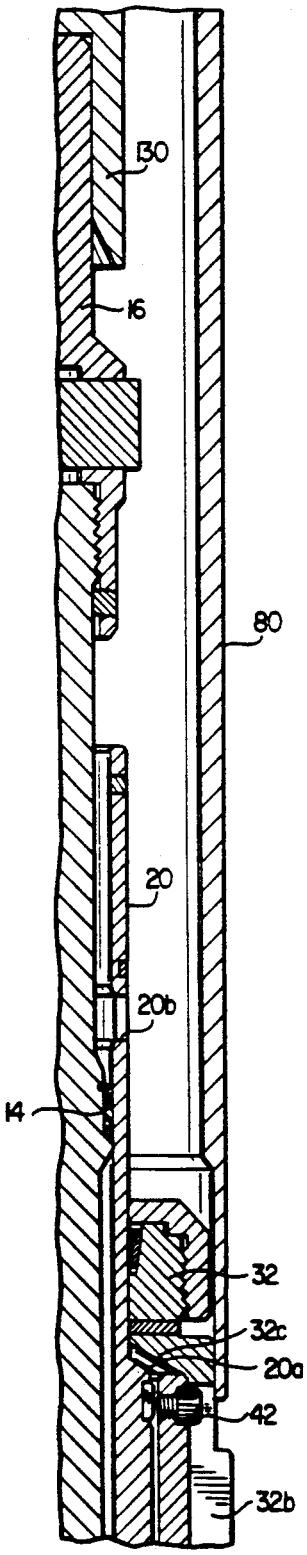
Figure 3C:
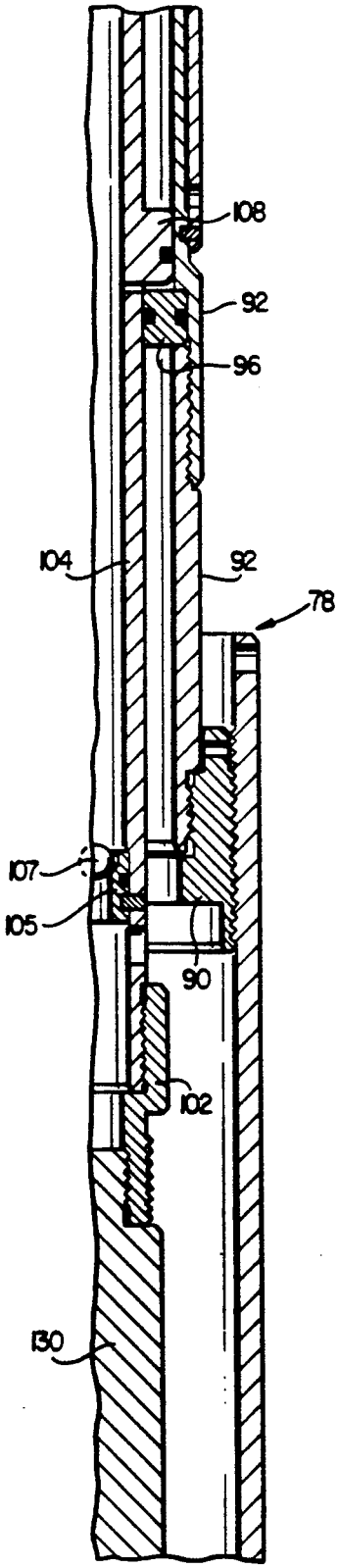
Figure 3D:
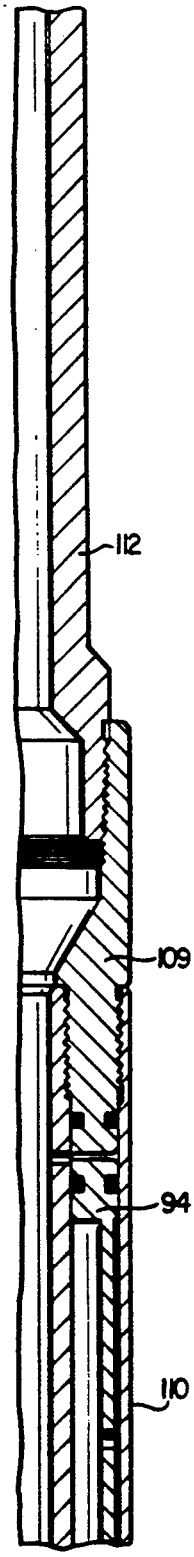

If it later becomes necessary to retrieve the bridge plug 10 from its set position in the wellbore tube, the actuating apparatus 78 is converted for pulling by replacing the sleeve 82 with an overshot 130 as shown in FIGS. 3B and 3C. The reeled tubing 118 and the converted actuating apparatus 78 is lowered into the wellbore tube in the position shown in FIGS. 3A–3D, which corresponds to the position of FIGS. 1A–1E, with the exception that the overshot 130 is in engagement with the upper end portion of the top sub 16. Although not clear from the drawings, it is understand that the overshot 130 includes a grasping mechanism, such as slip sleeves or the like, which, when lowered into the wellbore tube over the upper end portion of the sub 16, engage same.

Figure 4A:
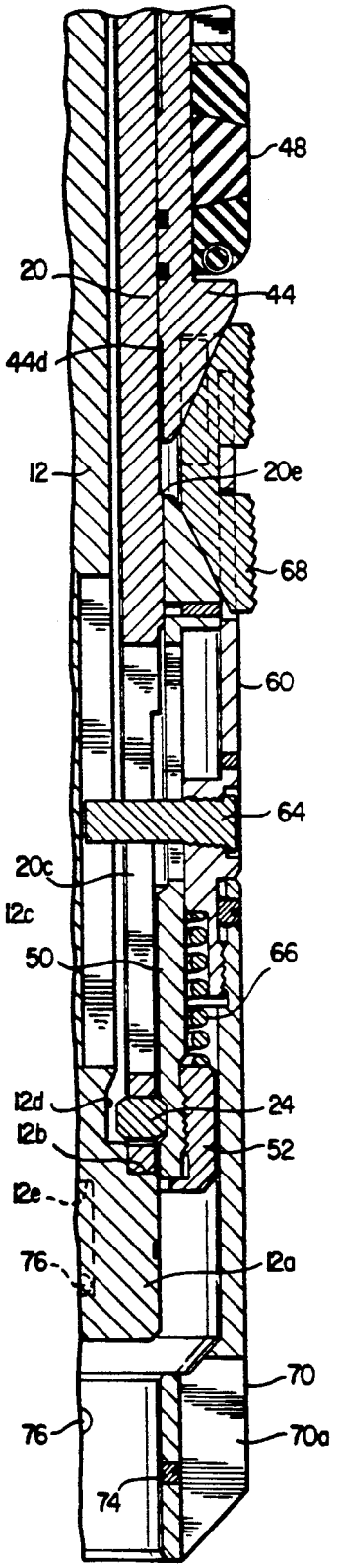

To initiate the retrieval operation fluid is introduced, via the reeled tubing 118, into the chambers defined between the pistons 96 and 108 and between the piston 94 and the end of the ring adapter 109 to drive the pistons 96 and 108, as well as the piston 94 and the ring adapter 109 in opposite directions as previously described. Since the slip members 68 are in locking engagement with the wellbore tube, the resulting forces will be an upwardly-directed force applied to the overshot 130, the sub 16 and therefore the inner mandrel 12. Upon a predetermined amount of upwardly-directed force applied in this manner, the pins 74 (FIG. 4A) break, permitting the inner mandrel 12 to move upwardly relative to the end cap 70 and the other components of the bridge plug 10, while the pins 76 ride in the longitudinal slots 12*e* in the inner mandrel. When the pins 76 reach the end of the slots 12*e* as shown in FIG. 4A, upward movement of the inner mandrel is temporarily stopped and the seal ring 14 is positioned upstream from the equalizer passages 20*b* to expose the latter slots. This establishes a wellbore fluid flow path through the plug 10 and allows any pressurized fluid in the wellbore below the bridge plug 10 to pass upwardly through the bridge plug via the equalizing passages 20*b* as described above to equalize the pressure across the bridge plug 10 and thus make it safe to unlock the bridge plug before it is removed in the manner described.

As the fluid pressure in the actuating apparatus 78 increases as described above, the upward pulling movement on the inner mandrel 12 continues until the pins 76 shear which permits further upward movement of the inner mandrel 12 relative to the end cap 70 until the shoulder 12*b* on the enlarged inner mandrel portion 12*a* engages the lower end of the outer mandrel 20 (FIG. 4A). At this position, the recess 12*d* formed in the lower end portion of the inner mandrel 12 aligns with the lugs 24 and thus permits the lugs to retract into the recess and thus release the lower wedge member 50 from the outer mandrel 20. The force of the spring 66 then forces the wedge member 50 downwardly out of engagement with the slip members 68 to the position shown in FIG. 1A.

Figure 4B:
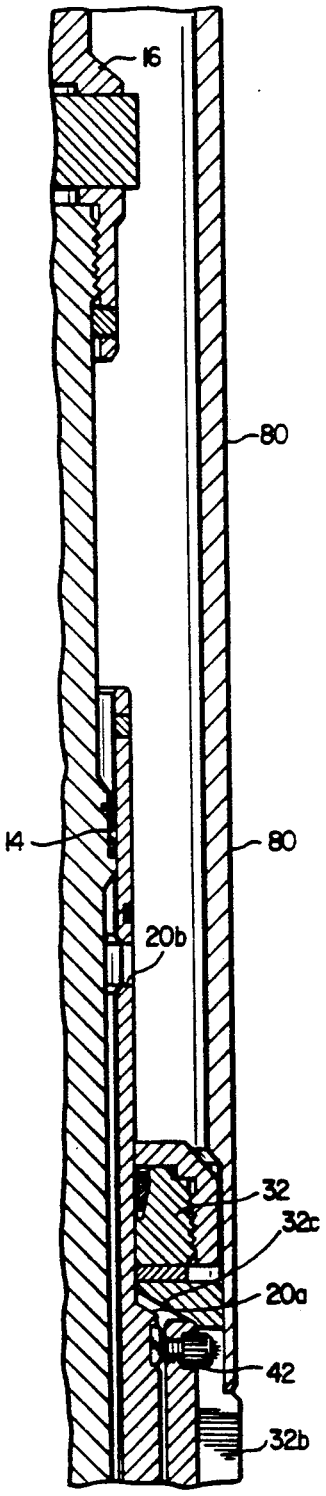
Figure 4C:
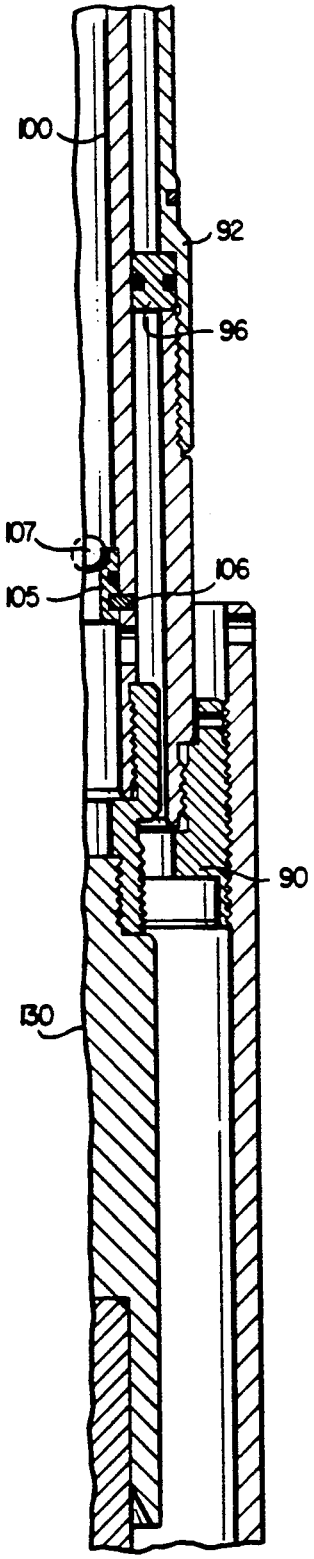
Figure 4D:
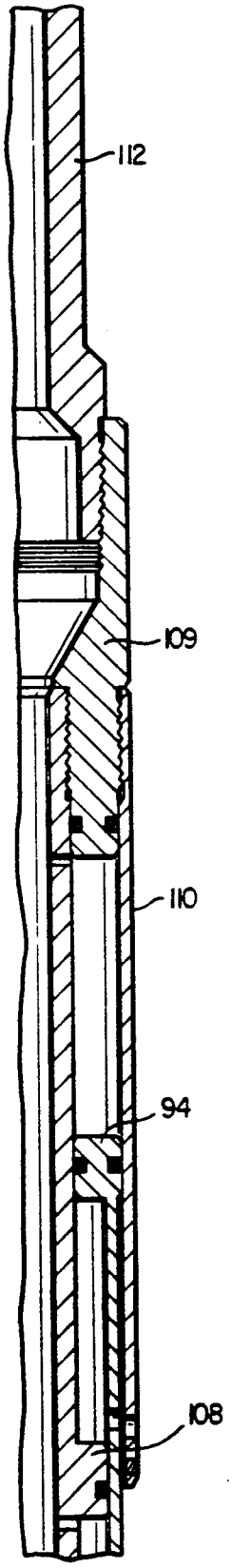

Referring to FIGS. 4A and 4B, further upward movement of the inner mandrel 12 forces the outer mandrel 20 upwardly until the shoulder 20*a* (FIG. 4B) on the outer mandrel engages internally downwardly facing shoulder 32*c* near the upper end of the retainer 32, and forces it, along with the upper wedge member 44, upwardly. This movement continues until the shoulder 20*e* (FIG. 4A) on the outer mandrel 20 contacts the shoulder 44*d* on the wedge member 44. Further upward movement in this manner forces the wedge member 44 out of engagement with the slip member 68 and relaxes the bridge plug assembly 10. This relative upward movement of the inner mandrel 12 and the outer mandrel 20 is terminated with engagement of the lower ends of the slots 12*c* and 20*c* with the bolt 64 (FIG. 4A). The bridge plug 10 is thus returned to the position of FIG. 1A and 1B with the exception that the inner mandrel 12 and the outer mandrel 20 are positioned upwardly from the position of FIG. 1A. The reeled tubing 118, the actuating apparatus 78, and the bridge plug 10 can then be pulled from the wellbore tube.

Several advantages result from the foregoing. For example, in the case of a deviated wellbore, the structural integrity and strength of the reeled tubing enables the bridge plug and the actuating apparatus to be pushed to the desired position in the wellbore. Also, the bridge plug can be hydraulically actuated, set and removed as described above. Further, the reeled tubing can be used to introduce fluids into the wellbore tube for various purposes, such as washing, etc., and the actuating apparatus 78 described above can easily be converted from a pushing tool to a pulling tool, and visa versa, by changing one component.

It is understood the several variations can be made in the foregoing without departing from the scope of the present invention. For example, the packing assembly described above can be in the form of a packer, which permits the flow of production fluid therethrough, rather than a bridge plug as described, which does not permit such flow.

A latitude of modification, change and substitution is intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. Apparatus for operating in a tube in a well containing fluid, said apparatus comprising:

two members adapted for relative movement; means responsive to said relative movement for engaging said tube;

hydraulically operated actuator means for receiving pressurized fluid and causing said relative movement in response to a predetermined pressure of said fluid for actuating said engaging means;

means for locking said engaging means in said tube-engaging position;

means for permitting flow of said well fluid through said apparatus before said actuating and for preventing said flow after said locking; and means for equalizing the pressure of said well fluid across said members.

2. Apparatus for operating in a tube in a well containing fluid, said apparatus comprising:

a mandrel;

a wedge assembly adapted for movement relative to said mandrel;

said wedge assembly comprising a first and a second member adapted for relative movement;

first engaging means responsive to a predetermined amount of movement of said wedge assembly relative to said mandrel for engaging a first portion of said tube;

second engaging means responsive to a predetermined amount of relative movement of said members of said wedge assembly for engaging an additional portion of said tube;

hydraulically operated actuator means for receiving pressurized fluid and causing said predetermined amount of movement of said wedge assembly in response to a first predetermined pressure of said pressurized fluid for actuating said first engaging means, said actuator means causing said predetermined amount of relative movement of said members of said wedge assembly in response to a second predetermined pressure of said pressurized fluid to actuate said second engaging means; and means for equalizing the pressure of said well fluid across said wedge assembly and said mandrel.

3. Apparatus for operating in a tube in a well containing fluid, said apparatus comprising:

two members adapted for relative movement;

means responsive to said relative movement for engaging said tube;

hydraulically operated actuator means for receiving pressurized fluid and causing said relative movement in response to a first predetermined pressure of said pressurized fluid for actuating said engaging means;

means responsive to a second predetermined pressure of said pressurized fluid for relieving said fluid pressure; and means for equalizing the pressure of said well fluid across said members.

4. Apparatus for operating in a tube in a well containing fluid, said apparatus comprising:

two members adapted for relative movement;

means responsive to said relative movement for engaging said tube;

hydraulically operated actuator means for receiving pressurized fluid and causing said relative movement to actuate said engaging means;

first locking means for locking a first portion of said engaging means in said tube-engaging position; and second locking means for locking a second portion of said engaging means in said tube-engaging position; and means for equalizing the pressure of said well fluid across said members.

5. Apparatus for operating in a tube in a well containing fluid, said apparatus comprising:

two members adapted for relative movement;

means responsive to said relative movement for engaging said tube;

hydraulically operated actuator means for receiving pressurized fluid and causing said relative movement in response to a predetermined pressure of said pressurized fluid for actuating said engaging means;

means for locking said engaging means in said tube-engaging position means for converting said actuator means to a pulling assembly for pulling said members from said tube; and means responsive to a predetermined amount of said pulling movement for equalizing the pressure of said well fluid across said member.

6. The apparatus of claim 5 further comprising means responsive to an additional amount of said pulling movement for releasing said locking means.

7. The apparatus of claim 6 wherein said actuator means operates in response to a first predetermined pressure of said pressurized fluid and wherein said locking means operates in response to a second predetermined pressure of said pressurized fluid.

8. The apparatus of claim 6 further comprising an inner mandrel, said two members extending over said inner mandrel in a coaxial relationship and adapted for axial movement relative thereto.

9. The apparatus of claim 8 further comprising means responsive to a predetermined amount of pulling movement for permitting movement of said inner mandrel relative movement of said inner mandrel relative to said members for releasing said locking means.

10. The apparatus of claim 5 wherein said engaging means comprises slip lock means adapted to be engaged by one of said members and forced into engagement with said tube.

11. The apparatus of claim 10 wherein one of said members includes a wedge portion for engaging said slip lock means and forcing it into engagement with said tube.

12. The apparatus of claim 10 wherein said locking means comprises a wedge member and means responsive to an additional amount of said relative movement for forcing said wedge member into engagement with said slip lock means.

13. The apparatus of claim 5 further comprising seal means disposed between said two members, said relative movement expanding said seal means into engagement with said tube.

14. The apparatus of claim 5 further comprising reeled tubing connected to said actuator means for supplying said pressurized fluid to said actuator means and for pushing said members through said tube.

15. A method for operating in a tube in a well containing fluid, said method comprising the steps of:

connecting an expandable wellbore tool to reeled tubing;

using said reeled tubing to insert said tool into said tube;

introducing pressurized fluid to said tool via said reeled tubing;

actuating said tool to expand a portion of said tool into engagement with said tube in response to a predetermined pressure of said pressurized fluid locking said tool in said tube-engaging position;

permitting flow of said well fluid through said tool before said actuating;

preventing flow of said well fluid after said locking; and equalizing the pressure of said well fluid across said tool.

16. A method for operating in a tube in a well containing fluid, said method comprising the steps of:

connecting an expandable wellbore tool to reeled tubing;

using said reeled tubing to insert said tool into said tube;

introducing pressurized fluid to said tool via said reeled tubing;

responding to first predetermined pressure of said fluid in said tool for moving a wedge assembly to expand a portion of said tool into engagement with a portion of said tube;

responding to a second predetermined pressure of said fluid in said tool for moving a portion of said wedge assembly relative to another portion thereof to expand another portion of said tool into engagement with another portion of said tube; and equalizing the pressure of said well fluid across said tool.

17. A method for operating in a tube in a well containing fluid, said method comprising the steps of:

connecting an expandable wellbore tool to reeled tubing;

using said reeled tubing to insert said tool into said tube;

introducing pressurized fluid to said tool via said reeled tubing;

actuating said tool to expand a portion of said tool into engagement with said tube in response to a first predetermined pressure of said pressurized fluid;

relieving said fluid pressure in response to a second predetermined pressure of said pressurized fluid; and equalizing the pressure of said well fluid across said tool.

18. A method for operating in a tube in a well containing fluid, said method comprising the steps of:

connecting an expandable wellbore tool to reeled tubing;

using said reeled tubing to insert said tool into said tube;

introducing pressurized fluid to said tool via said reeled tubing;

expanding a portion of said tool into engagement with said tube in response to a predetermined pressure of said pressurized fluid;

locking a first portion of said expanded tool portion in said tube-engaging position;

locking a second portion of said expanded tool portion in said tube-engaging position; and equalizing the pressure of said well fluid across said tool.

19. A method for operating in a tube in a well containing fluid, said method comprising the steps of:

connecting an expandable wellbore tool to reeled tubing;

using said reeled tubing to insert said tool into said tube;

connecting an actuator to said tool;

introducing pressurized fluid to said actuator via said reeled tubing to actuate said actuator and expand a portion of said tool into engagement with said tube in response to a first predetermined pressure of said pressurized fluid;

locking said tool in said tube-engaging position;

disconnecting said actuator from said tool in response to a second predetermined pressure of said pressurized fluid, connecting a pulling assembly to said tool for pulling said tool from said wellbore tube; and equalizing the pressure of said well fluid across said tool in response to a predetermined pulling force.

20. The method of claim 19 further comprising the steps of permitting flow of said well fluid through said apparatus before said introducing and preventing flow of said well fluid after said locking.

21. The method of claim 19 wherein said step of locking is in response to a third predetermined pressure of said pressurized fluid.

22. The method of claim 19 further comprising the step of relieving said fluid pressure in response to a third predetermined pressure of said pressurized fluid.

23. The method of claim 19 further comprising the step of expanding another portion of said tool into engagement with said tube.

24. The method of claim 19 further comprising the step of unlocking said tool from said tube-engaging positing before the second-mentioned step of connecting.

* * * * *

UNITED STATES PATENT AND TRADEMARK OFFICE

CERTIFICATE OF CORRECTION

PATENT NO. : 5,146,994

DATED : September 15, 1992

INVENTOR(S) : Charles W. Pleasants

It is certified that error appears in the above-identified patent and that said Letters Patent is hereby corrected as shown below:

Column 1, line 26, change "ar" to -- are --.

Column 6, line 45, change "angularly spaced" to -- angularly-spaced --.

Column 6, line 46, change "radially extending" to -- radially-extending --.

Column 7, line 31, change "plug 1" to -- plug 10 --.

Column 8, line 38, change "tube engaging" to -- tube-engaging --.

Column 12, line 8, change "member" to -- members --.

Column 12, line 23, after "mandrel" add -- relative to said members, and means responsive to said --.

Signed and Sealed this

Twenty-eighth Day of September, 1993

*Attest:*

Bruce Lehman

BRUCE LEHMAN

*Attesting Officer*

*Commissioner of Patents and Trademarks*